US006100810A

United States Patent [19]

Koorsen

[11] Patent Number: 6,100,810

[45] Date of Patent: Aug. 8, 2000

[54] SENSING APPARATUS FOR CONTROLLING THE ASSEMBLY OF RAFTERS BY MONITORING THE POSITION METALLIC FASTENERS

[76] Inventor: John R. Koorsen, 1104 S. 1st St., Marshalltown, Iowa 50158

[21] Appl. No.: 09/406,176

[22] Filed: Sep. 24, 1999

[51] Int. Cl.[7] ..... G08B 21/00

[52] U.S. Cl. ..... 340/686.5; 340/674; 382/141; 382/286; 29/721

[58] Field of Search ..... 340/686.5, 674; 382/141, 286; 29/721

[56] References Cited

U.S. PATENT DOCUMENTS

| | | | |
|---|---|---|---|
| 2,934,698 | 4/1960 | Longland . | |
| 3,430,221 | 2/1969 | Barringer . | |
| 3,857,020 | 12/1974 | Higginbotham et al. | 235/61.11 E |
| 4,096,437 | 6/1978 | Kitzinger . | |
| 4,488,113 | 12/1984 | Heemstra . | |
| 4,514,899 | 5/1985 | Burger | 29/721 |
| 5,063,347 | 11/1991 | Shigemo . | |
| 5,264,733 | 11/1993 | Tigges . | |
| 5,440,977 | 8/1995 | Poutanen | 100/39 |
| 5,506,914 | 4/1996 | Baker | 382/141 |
| 5,617,025 | 4/1997 | Taylor et al. . | |
| 5,646,859 | 7/1997 | Petta et al. | 364/468.01 |
| 5,831,431 | 11/1998 | Gottfried-Gottfried et al. . | |
| 5,929,765 | 7/1999 | Urech et al. | 340/674 |

*Primary Examiner*—Jeffery A. Hofsass
*Assistant Examiner*—Tai Nguyen
*Attorney, Agent, or Firm*—Kent A. Henrik, Esq.; Davis, Brown, Koehn, Shors & Roberts, P.C.

[57] ABSTRACT

A detection control apparatus for the assembly of building components such as rafters, trusses, and the like. A pair of sensors located at the output side of a press for assembling the building components detects metal connecting plates that are intended to be positioned on opposite sides of the building component being assembled. If one of the plates is detected while the other is missing or out of position, the apparatus generates an alarm to signal an operator or automatically shuts down the press so that the missing or out-of-position connecting plate can be corrected.

5 Claims, 3 Drawing Sheets

SENSING APPARATUS FOR CONTROLLING THE ASSEMBLY OF RAFTERS BY MONITORING THE POSITION METALLIC FASTENERS

BACKGROUND OF THE INVENTION

1. Field of the Invention

The invention relates generally to control apparatus for machines which assemble wooden rafters or the like and, more specifically, to a detection apparatus which will determine the presence or absence of a nailing plate at predetermined positions and affect control of the assembly apparatus to prevent further assembly if a required plate is missing or out of position.

2. Background of the Invention

The housing industry has moved toward greater use of pre-assembled components. These components, such as rafters or trusses, are assembled in a factory and shipped to the construction site. The use of pre-assembled components saves labor at the construction site, results in more uniform components and are less expensive to manufacture than stick-built components. The individual lumber elements of the rafters, trusses, or other components, are commonly secured to each other in the assembly of the building component by the use of connector plates with struck teeth. The connector plates are positioned in pairs opposite of each other on either side of the component being assembled. The connectors are positioned and then pressed into place in an assembly line process when they pass between a pair of rollers. Obviously, if one of the connecting plates is missing or is not in the appropriate position, the building component will not be assembled correctly and may not have the full designed strength or dimensions. There is a need, accordingly, to detect the proper positioning of the connector plates during assembly so as to avoid production of defective building components.

SUMMARY OF THE INVENTION

The invention consists of a detection control apparatus for the assembly of rafters, trusses, and the like. The chord and strut members of the building component are placed in their appropriate position and metal connecting plates are placed on the top and bottom sides of a joint being formed. The partially assembled building component is then conveyed to a press or roller machine which will embed the teeth of the connector plates into the lumber chords and strut members. A pair of sensors for detecting electrically conducting materials are positioned downstream of the roller machine with one sensor being in detecting proximity of the top surface of the partially assembled building component and the other sensor being in detecting proximity to the lower surface of the building component. The sensors are connected to a computer control apparatus. As the metal connecting plates pass by the sensors, a signal is transmitted to the control apparatus. Because the connector plates are intended to be used in pairs and placed oppositly each other on either side of the building component, the failure of one of the sensors to detect a connecting plate while the other sensor is detecting a metal plate will indicate to the control apparatus that a connecting plate is missing. Similarly, if the signal from one of the sensors is not received in the same time period as the signal for the other sensor, it means one or both of the connecting plates are out of position.

There is no mechanical or electrical contact between the detection apparatus and the building component, thereby eliminating wear and many of the adjustment problems that may otherwise exist.

An object to the invention is to provide an improved apparatus for detecting the presence and position of metal connecting plates used in the assembly of rafters, trusses, and similar building components.

Another object of the invention is to provide a metal connecting plate detection apparatus which is sensitive to the presence or absence of a connecting plate in a particular location and is insensitive to corresponding, oppositly positioned connecting plates.

These and other objects of the invention will be made apparent to persons skilled in the art upon a review and understanding of this specification, the associated drawings, and the appended claims.

DETAILED DESCRIPTION OF PREFERRED EMBODIMENTS

In the assembly of building components from dimensional lumber and metal connecting plates having struck teeth, the dimensional lumber is first cut to size and shape. The connecting plates are positioned on a table with the teeth pointing upwardly and the dimensional lumber which forms the chords and spanning members of the building component are placed on top of the connecting members in the appropriate positions. Then corresponding connecting members are placed on top of lumber elements positioned above the oppositly facing bottom connecting plates. This partially assembled truss is then conveyed in its horizontal orientation from the assembly table toward a press or rolling machine.

Figure 1:
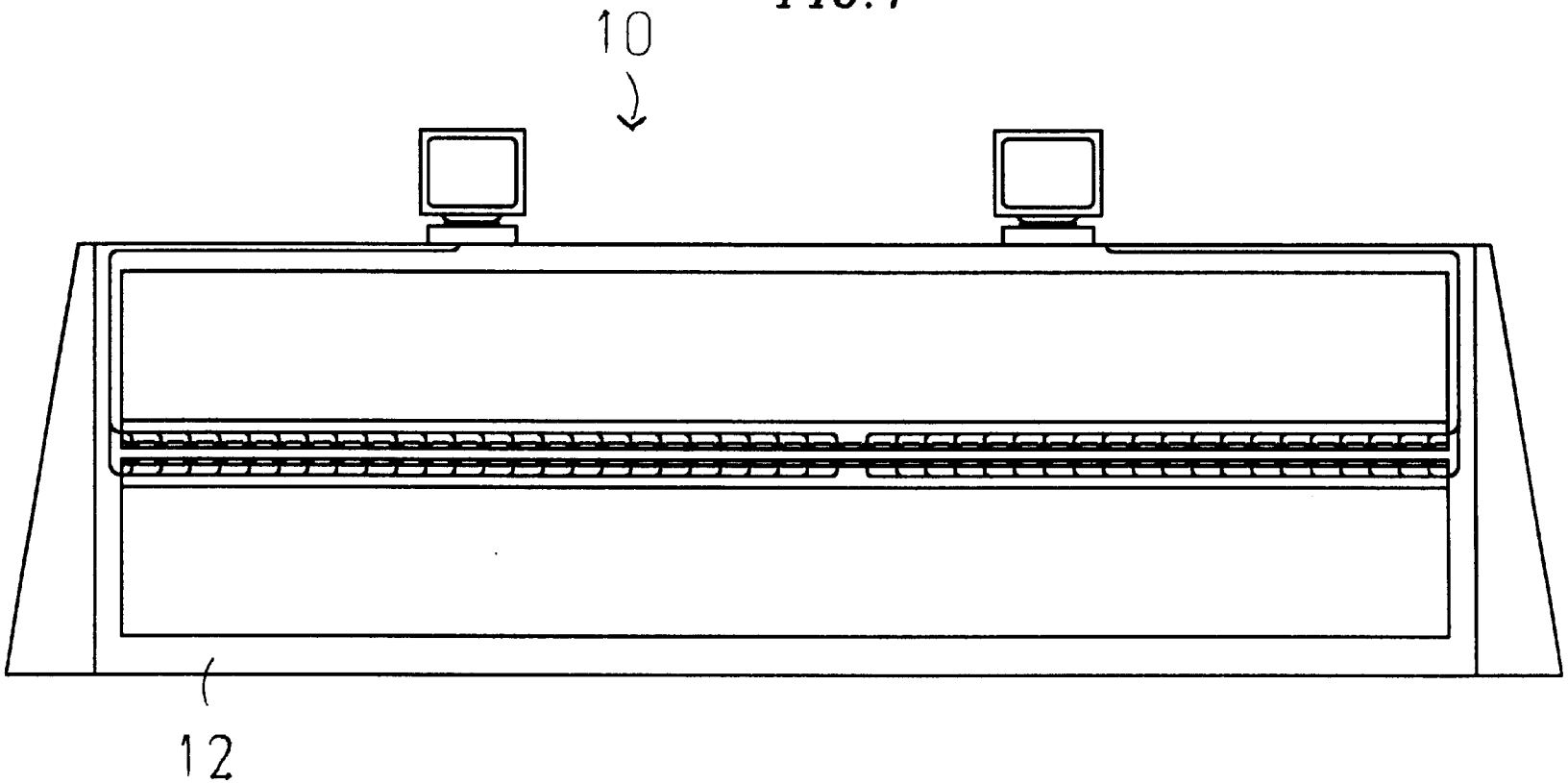
FIG. 1 is a front elevational view of a roller machine which is controlled by the present apparatus.
Figure 2:
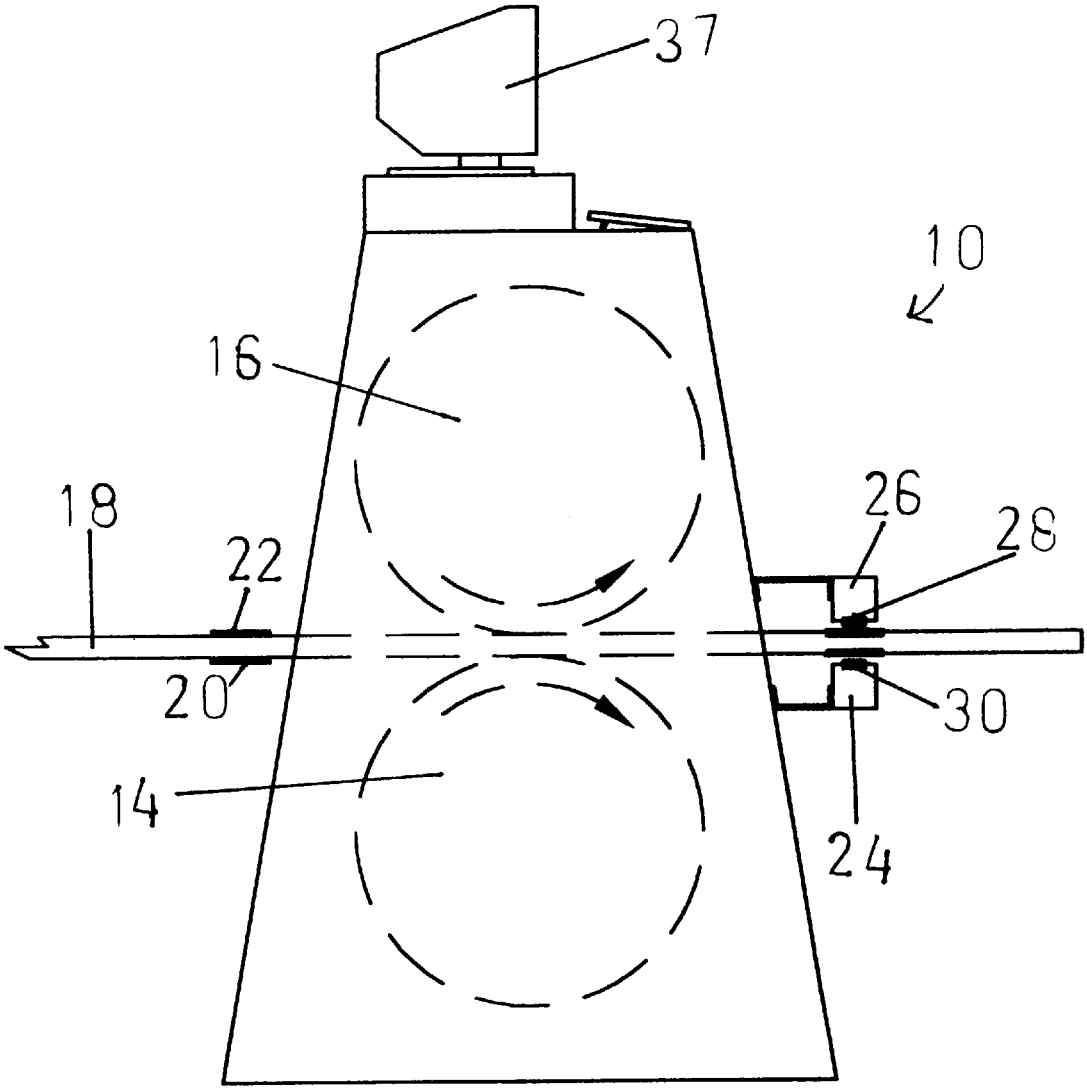
FIG. 2 is a side view of the apparatus of FIG. 1 showing in broken lines the action of a pair of reversly rotating rollers on a building component being assembled by the machine and a pair of sensors which form a part of the control apparatus.

Referring to the drawings, illustrated in FIG. 1, generally at 10, is a rolling machine or press that is commonly used in the assembly of rafters, trusses, and similar building components from dimensional lumber. The rolling machine 10 has a transversally extended frame 12. As is best illustrated in FIG. 2, the rolling machine 10 includes a pair of oppositly rotating cylinders 14 and 16 which engage the rafter 18, pulling it through the rolling machine 10.

As the partially assembled truss 18 is pulled through the rollers 14 and 16, the rollers press against the top and bottom surfaces of the partially assembled truss 18 and so will drive a pair of metal connecting plates 20 and 22 into the lumber elements thus completing assembly of the truss 18. If the connecting plates 20 and 22 were properly positioned on the assembly table and have stayed in their proper position, the truss 18 will be correctly constructed and will have the specified dimensions and strength. If, however, one of the connector plates 20 or 22 was omitted, fell out of position, or moved out of position prior to reaching the rolling machine 10, the assembled truss 18 will not be constructed correctly.

Figure 4:
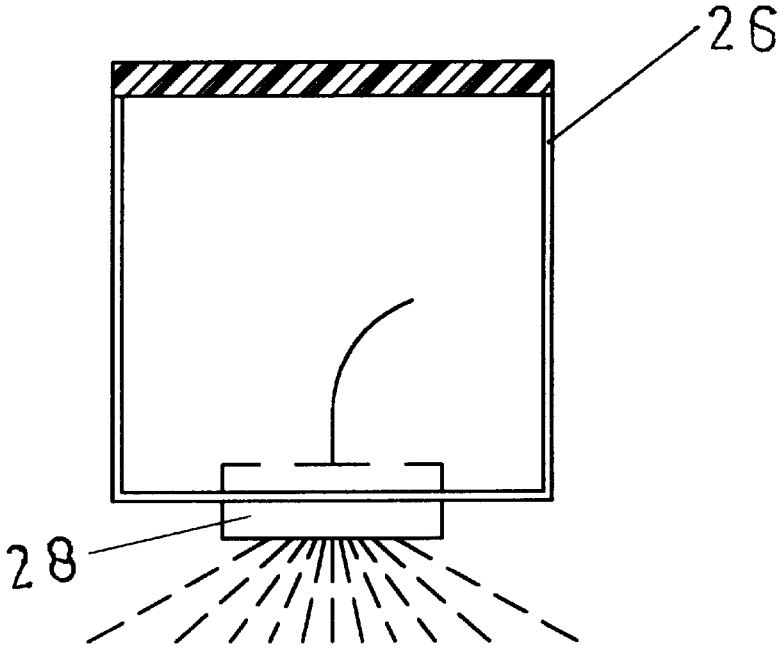
FIG. 4 is an enlarged detailed view of the mounting of a sensor.

A pair of sensor mounts 24 and 26 are attached to the downstream or output side of the rolling machine 10, with the sensor mounting unit 24 being positioned below the exiting truss 18 and the sensor mounting unit 26 being positioned above the exiting truss 18. As best illustrated in FIG. 4, the sensor mounting unit 24 supports a Hall effect sensor 28 which is located on the bottom side of the sensor mounting unit 26. The sensor mounting unit 24 also is provided with a Hall effect sensor 30 and is oriented to support the sensor 30 in proximity to the underside of the truss 18.

The Hall effect sensors 28 and 30 rely on the Hall effect to detect electrically conducting material, such as the connecting plates 20 and 22, that is within sensing proximity of the sensors 28 and 30. In the preferred embodiment, the Hall effect sensors are model numbers NI-25-Q20-AP6X/7M for sensor 26 and NI-25-Q20-AP6X2/7M for sensor 24 obtained from the Truck Manufacturing Company of Minneapolis, Minn. These particular Hall effect sensors have the ability to detect typical metal connecting plates when positioned within a range of between about 0.0625 inches and 0.5 inches. The most common dimensional lumber used in the construction of the building components; such as the truss 18, is lumber which is 1½" in thickness. Accordingly, the Hall effect sensors 28, 30 are positioned so that the adjacent metal connecting plate 22, 20 will be within detecting proximity of the corresponding sensor while the connecting plate on the opposite side of the building component will be outside of the detecting proximity of the first sensor and within the detecting proximity of the second or opposite sensor. Referring to FIG. 2, Hall effect sensor 28 will detect the presence of connecting plate 22 but will not detect the presence of connecting plate 20 and, correspondingly, Hall effect sensor 30 will detect the presence of connecting plate 20 and will not detect the presence of connecting plate 22.

Figure 3:
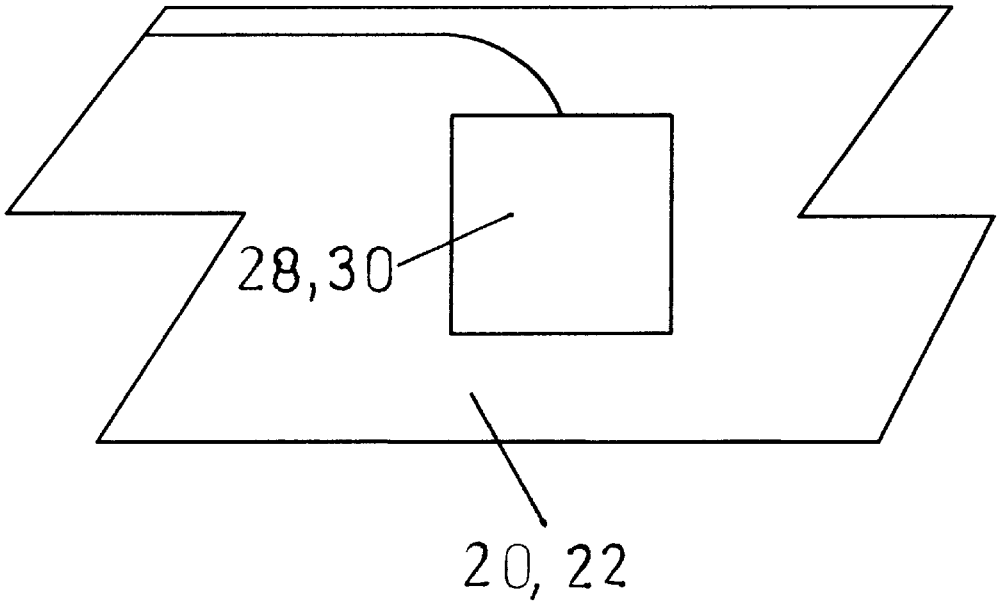
FIG. 3 is an enlarged detailed view showing a sensor and an exemplary metal connecting plate.

The Hall effect sensors are connected to a computer control apparatus 32 (FIG. 2). The computer control apparatus 32 accordingly receives signals from the Hall effect sensors 28 and 30 whenever a connecting plate is within detecting proximity of the sensors, as in FIG. 3. Since the connecting plates move past the Hall effect sensors as the building component is moved through the roller press, a signal will be received by the computer control apparatus 32 when the leading edge of a connecting plate is first detected by the corresponding sensor and will be continuously received until the trailing edge of the connecting plate moves outside the detecting proximity of the sensor. The computer control apparatus is programmed so that if a signal is received from one of the sensors and, within a preset time period, another corresponding signal is not received from the other sensor, an alarm will be generated to signal to the operator of the roller machine that a connecting plate is missing or, alternatively, the computer control apparatus 32 may be configured to automatically shut down the roller machine 10. In a similar fashion, the computer control apparatus 32 can also detect if one or the other of the connecting plates is moved substantially out of position because there will be a delay greater than the preset time period in the reception of signals from the two Hall effect sensors. The computer control apparatus 32 will be programmed to also generate an alarm or automatically shut down the roller machine 10 if out-of-position connecting plates are detected. The amount of the time period by which detection of connecting plate signals from the sensors can be different will depend on the sensitivity of the Hall effect sensors, the speed at which the building component moves through the roller machine, and the desired tolerances for alignment of corresponding pairs of connecting plates.

In the preferred embodiment, the Hall effect sensors are positioned approximately 2.375 inches apart so that they are approximately 0.4375 inches distant from the corresponding one of the connecting plate. The speed with which the building components travel through the roller machine is approximately 134 feet per minute. Since the minimum range over which the Hall effect sensors detect the leading and trailing edges of the connecting plate is approximately 1.5 inches, the sensors are capable of detecting a discrepancy in the placement of the connecting plates within about 1.34 inches.

Although the invention has been described with respect to a preferred embodiment thereof, it is to be also understood that it is not to be so limited since changes and modifications can be made therein which are within the full intended scope of this invention as defined by the appended claims.

I claim:

1. Apparatus for sensing an out-of position metal connecting plate used in the assembly of rafters in a press which receives pre-assembled building component and outputs assembled building components, the apparatus comprising:

(a) a pair of sensors for detecting electrically conducting material positioned at the output side of the press wherein one of the sensors is positioned in detecting proximity to a connecting plate on a first side of the building component and the other sensor is positioned in detecting proximity to a corresponding connecting plate positioned on a second side of the building component opposite of the first connecting plate;

(b) computer control apparatus operatively connected to said sensors which receives a signal from the first connecting plate sensor when it is in detecting proximity to a connecting plate and which receives a signal from the second connecting plate sensor when it is in detecting proximity to the other, corresponding connecting plate; and (c) an alarm generated by said computer control apparatus when the difference in time of the reception of said signals is greater than a predetermined maximum interval.

2. Apparatus as defined in claim 1, wherein said sensors are Hall effect sensors.

3. Apparatus as defined in claim 1, wherein said press includes a pair of oppositly rotating rollers which force the connecting plates into secure engagement with the pre-assembled building components to create the assembled building components.

4. Apparatus as defined in claim 3, wherein said rollers rotate about parallel horizontal axis so that the building component passes through the press in a horizontal orientation; and wherein said sensors are positioned with a first of said sensors above the building component and the second of said sensors positioned below the building component.

5. Apparatus as defined in claim 1, further comprising control apparatus associated with said press and operatively connected to said computer control apparatus; and wherein said alarm generated by said computer control apparatus is transmitted to said press control apparatus to shut down said press.

* * * * *